United States Patent [19]

Allen

[11] 4,224,987

[45] Sep. 30, 1980

[54] WELL TOOL

[75] Inventor: Richard G. Allen, Houston, Tex.

[73] Assignee: Brown Oil Tools, Inc., Houston, Tex.

[21] Appl. No.: 877,121

[22] Filed: Feb. 13, 1978

[51] Int. Cl.[2] ..... E21B 33/128; E21B 33/129

[52] U.S. Cl. ..... 166/120; 166/179

[58] Field of Search ..... 166/120, 118, 179, 122, 166/123, 133, 146, 6 PD; 175/307

[56] References Cited

U.S. PATENT DOCUMENTS

| | | | |
|---|---|---|---|
| 3,142,338 | 7/1964 | Brown | 166/118 |
| 3,459,261 | 8/1969 | Cochran | 166/120 |
| 3,460,616 | 8/1969 | Tucker et al. | 166/120 |
| 4,044,826 | 8/1977 | Crowe | 166/120 |

FOREIGN PATENT DOCUMENTS

| | | | |
|---|---|---|---|
| 417608 | 7/1974 | U.S.S.R. | 166/120 |

*Primary Examiner*—William F. Pate, III
*Attorney, Agent, or Firm*—Robert A. Felsman

[57] ABSTRACT

The invention comprises a packer which seals against a surrounding well conduit. The packer comprises a mandrel which carries a radially extendable seal for engaging the well conduit. A hydraulic actuator is provided for urging the seal to its set position against the well conduit. Once set, the tool is responsive to fluid pressure differentials in the well conduit across the seal in either longitudinal direction to tighten the seal means. The cylinder of the actuator also serves as a guard to overlie and protect the seal in its unset position, while the piston is designed to define auxiliary piston area to reduce the required setting pressure. The seal is set by being extruded both longitudinally and radially over a retainer extending radially outwardly from the mandrel.

43 Claims, 11 Drawing Figures

WELL TOOL

BACKGROUND OF THE INVENTION

1. Field of the Invention

The present invention relates to means for sealing within a flow conduit for controlling fluid flow therein. In particular, the invention comprises a packer for sealing against a surrounding well conduit. The invention is particularly, though not exclusively, adapted to hydraulic set packers operated by fluid pressure applied via the tool mandrel and its supporting tubing string.

2. Description of the Prior Art

One of the problems associated with many conventional packers is that of leakage due to high pressures within the well conduit being sealed. For example, in a typical hydraulic set packer, if the pressure within the well exceeds the effective hydraulic setting pressure, leakage past the packer seal may occur. There is need for a relatively simple and economical packer which will effectively seal against such leakage without the application of excessive internal setting pressure and, in particular, one in which the seal will be tightened in its set position upon the presence of well pressure differentials across the seal in either longitudinal direction.

Another problem associated with the use of conventional packers is that the seal, being generally in an exposed and vulnerable position on the exterior of the tool, is subject to damage. For example, when the tool is being run into the well, it may be damaged by contact with internal obstructions or irregularities in the well conduit. Rapid lowering of the packer increases the likelihood of such damage and may also create a swabbing effect which can itself damage the seal and/or cause premature setting of the packer. Another occasion for seal damage may occur after the tool has been lowered into the desired position, but before it has been set, due to the abrading effects of sand and other material in the well fluid which may be circulated about the seal. Thus, in the past it has frequently been necessary to lower the packer into the well slowly to avoid such damage.

Another disadvantage of many conventional hydraulic set packers is that, in order to provide an adequate stroke for the piston of the seal actuator, the packer must be made relatively long and is consequently difficult and sometimes impossible to maneuver in tortuous well conduits. Attempts to shorten the overall packer length made at the expense of the size of the seal may result in reduced sealing effectiveness.

There is therefore a need for an improved packer, and in particular for a hydraulic set packer, which will alleviate these and other problems in conventional prior art tools.

SUMMARY OF THE INVENTION

The present invention addresses the above problems and provides a fluid pressure operated packer which includes means associated with the seal and responsive to well pressure differentials across the seal in either longitudinal direction to tighten the seal in its set position. This is accomplished through the provision of a fluid pressure reaction area adjacent one end of the seal which exceeds the transverse cross-sectional area of the other end of the seal in its unset position. Thus the packer will not leak even if the pressure on the high pressure side of the seal exceeds the effective setting pressure. Furthermore, the seal actuator defines primary and auxiliary piston areas which together exceed the transverse seal area in the unset position. This permits the use of an actual setting pressure less than the effective setting pressure.

The packer of the invention also includes a guard which overlies the seal in its unset position. Thus the packer may be lowered into the well conduit relatively rapidly, abrasive fluids may be circulated about the packer, etc. without damage to the seal. The seal and guard are selectively relatively longitudinally movable to at least partially expose the seal for movement to its set position. Preferably, the guard is formed by the cylinder for the piston of the seal actuator. Since the unset seal thus occupies part of the cylinder space, rather than resting thereabove (as in conventional hydraulic set packers) the total length of the tool is shortened without sacrificing sealing effectiveness.

The packer preferably also includes an anchor assembly comprising radially extendable gripping elements such as slips. The anchor assembly has a respective hydraulic actuator whose piston moves in a direction opposite that of the seal actuator during setting. Accordingly, the seal guard may be attached to the anchor actuator piston for movement therewith so that the guard is automatically longitudinally displaced to expose the seal during setting. Furthermore, means such as shear members are provided to prevent premature setting of the seal and/or anchor assembly. Whereas in conventional packers, having a common actuator for the seal and anchor assemblies, it was necessary to design such shear members to sever in a predetermined specific order, the shear members of the instant tool may be designed to shear at random or simultaneously due to the aforementioned actuator design.

The present packer also preferably includes a retainer adjacent the end of the seal distal its actuator piston and extending radially outwardly from the mandrel. The retainer restricts movement of only the inner portion of the adjacent end of the seal, the outer portion being longitudinally movable. Thus, as the actuator piston moves toward the retainer, the seal is extruded both longitudinally and radially outwardly over the retainer. This provides several advantages. In the first place, the retainer displaces the inner extremity of the adjacent portion of the seal radially outwardly. Thus the total volume of elastomeric seal material needed to bridge the annulus to be sealed is reduced. Furthermore, the stretching of the elastomer up and over the retainer eliminates the possibility of buckling and consequent leakage along the inner extremity of the seal. Finally, the retainer contributes to the seal tightening effect mentioned above by reducing the seal area distal the seal actuator.

Accordingly, it is a principal object of the present invention to provide an improved fluid pressure set packer.

Another object of the invention is to provide a packer having means for tightening the seal in its set position upon the presence of fluid pressure differentials thereacross in either longitudinal direction in the sealed conduit.

Still another object of the invention is to provide a fluid pressure set packer having guard means for overlying and protecting the seal in its unset position.

A further object of the invention is to provide a hydraulic set packer in which the seal in its unset position occupies a portion of the actuator cylinder for the seal.

Yet another object of the invention is to provide a well tool having a seal longitudinally and radially outwardly extrudable over a retainer extending radially outwardly from the tool mandrel.

Still other objects, features, and advantages of the present invention will be made apparent by the following description of the preferred embodiments, the drawings, and the claims.

DESCRIPTION OF THE PREFERRED EMBODIMENTS

Figure 1:
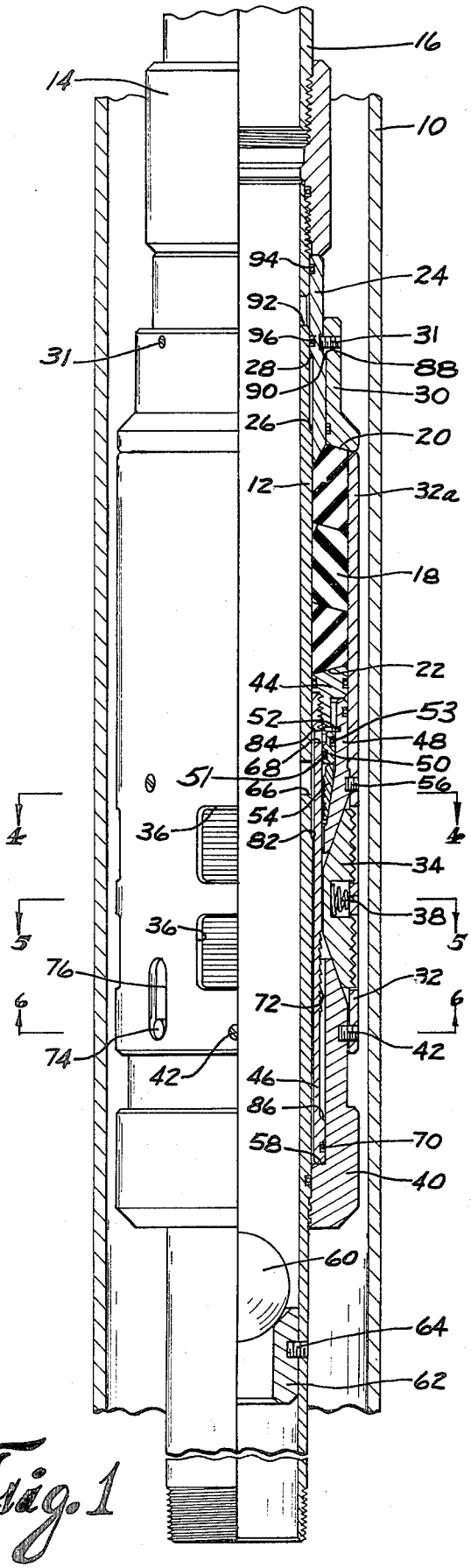
FIG. 1 is a longitudinal quarter-sectional view of a packer according to the present invention just prior to setting.

Referring now to FIGS. 1 and 4–6, there is shown a packer according to a first embodiment of the invention designed for use in anchoring and sealing against the interior of a well casing 10. While the invention will be described in relation to hydraulic set packers, it is applicable to any fluid pressure operated sealing tool, and certain features of the invention are also applicable to mechanically set tools. The packer includes a tubular mandrel assembly comprised of a main body portion 12 and a collar 14 used to connect the main body 12 to the lower end of an operating string 16. The lower end of the main body 12 forms a threaded pin by which other sections of pipe or tubing, other tools, or the like may be connected below the packer.

A seal assembly 18 is slidably carried about the main body 12. Seal assembly 18 comprises a plurality of elastomeric seal rings positioned end-to-end and encircling the body 12. The seal assembly has opposite axial ends 20 and 22. Upper end 20 of the seal assembly 18 has a radially inner portion which abuts a retainer sleeve 24 slidably disposed on the body 12. Upward movement of sleeve 24 on the body 12 is limited by the lower end of the collar 14. Downward movement of sleeve 24 on the body 12 is limited by an upwardly facing external annular shoulder 26 on the body 12 and an opposing downwardly facing internal annular shoulder 28 on the sleeve 24. The radially outer portion of the upper end 20 of seal assembly 18 abuts the lower end of a restraining collar 30 releaseably secured to the sleeve 24 by a plurality of shear pins 31.

An anchor assembly is carried by the body 12 below the seal 18. The anchor assembly comprises a generally cylindrical slip cage 32 coaxially surrounding the body 12. A plurality of gripping elements in the form of slips 34 is carried by the cage 32. The slips 34 may be radially extended and retracted through radial openings 36 in the cage 32. A compression spring 38 is interposed between each of the slips 34 and the interior of the cage 32 to bias the slips 34 radially inwardly. However, the slips 34 may be urged outwardly against the bias of springs 38, in a manner to be described more fully below, and are equipped with teeth on their radially outer surfaces for gripping the casing 10 to hold the packer in a fixed position relative thereto. A lower expander cone 40 is threadedly secured to the body 12 and has an upper portion extending into the lower end of the slip cage 32. Cage 32 is releaseably secured to the expander 40 by a plurality of shear pins 42. The cage 32 extends upwardly from the locus of the slips 34 to form a guard sleeve **32*a* which, in the running-in position shown in FIG. 1, completely covers the unset seal assembly 18 and abuts the outer portion of the lower end of restraining collar 30**.

A pair of actuator assemblies are carried generally between the seal assembly 18 and the anchor slips 34. The first or seal actuator assembly comprises an annular abutment member 44 abutting the lower end 22 of the seal assembly 18. The lower portion of the abutment member 44 is counterbored and internally threaded to receive the upper end of a lock sleeve 46 which extends downwardly along the body 12 and into the lower expander cone 40 as shown. The member 44 is sealed with respect to the sleeve **32*a* and the body 12 by O-ring seals disposed in its radially outer and inner surfaces respectively. The upper portion of sleeve 32*a* serves as a cylinder surrounding members 44 and 46** which themselves form the piston means of the seal actuator.

The second or anchor actuator assembly comprises an upper expander cone 48 and a holder ring 50 disposed coaxially therein. Upward movement of the ring 50 in the expander cone 48 is limited by a snap ring 52 disposed in an internal annular groove in the expander 48. Downward movement of ring 50 is limited by a lock ring 54, to be described more fully hereafter, located below ring 50 and trapped between the sleeve 46 and the expander cone 48. Expander cone 48 is sealed with respect to sleeve **32*a* by an O-ring carried in an external groove in the expander 48. Ring 50 is sealed against the exterior of sleeve 46 and against the interior of expander 48 by respective O-rings 51 and 53 carried on the interior and exterior, respectively, of holder ring 50. Thus expander 48 and holder ring 50** are enabled to act together as a piston for the anchor actuator assembly.

FIG. 1 shows the packer in an initial condition as it would appear during running-in and also just prior to setting with the seal and anchor assemblies in their unset positions. All parts of the seal assembly, anchor assembly, and the two actuator assemblies are held in substantially fixed position with respect to the mandrel 12, 14 by the cooperative relation between these parts and, ultimately, by three sets of shear pins 31, 42 and 52 along with the lower expander 40. Expander 40 is fixed to body 12 by the threaded connection therebetween. The anchor assembly 32, 34, as well as the sleeve **32*a* and integral slip cage 32, are held fixed with respect to the expander 40 by the set of shear pins 42. Pins 42 fix the anchor assembly, and prevent premature setting which might otherwise occur upon relative downward movement of the anchor assembly over the lower expander 40. The inner diameter of the upper portion of expander 40 is enlarged to receive the lower end of lock sleeve 46 and to form an upwardly facing shoulder 58 which abuts the lower end of sleeve 46 thereby supporting the seal actuator piston means 44, 46. Upward movement of the piston means 44, 46, is prevented by the seal assembly 18 which is constrained against radial deformation by the sleeve 32***a* and against longitudinal movement by the retainer sleeve 24, which abuts collar 14, and by the restraining collar 30 connected to sleeve 24 by shear pins 31. Finally, shear pins 56 interconnect the anchor actuator piston means 48, 50 with the sleeve 32*a* to fix the anchor actuator assembly and prevent premature setting of the anchor assembly by downward movement of the expander 48 with respect thereto.

The packer, in the initial condition of FIG. 1, may be run into the casing 10 relatively quickly as compared with conventional packers since the sleeve 32*a* covers and protects the seal assembly 18 from damage due to contact with the wellhead apparatus, casing, or other subsurface apparatus. The sleeve 32*a* also prevents the seal elments from extending radially due to the pressure differential which is developed as the packer is moved through a wet casing string. Once in place, sandy fluids, mud, or other abrasive fluids may be circulated around the packer without danger of erosion or other damage to the elastomeric seal elements, which are protected by sleeve 32*a*.

The pins 42 and collar 40, which fix the guard sleeve 32*a* to the body 12, and the collar 30, pins 31 and sleeve 24, which interconnect the body 12 with the upper end of sleeve 32*a*, serve as control means to prevent relative longitudinal movement between seal 18 and sleeve 32*a* during running-in and thereby releasably retain sleeve 32*a* in overlying relation to seal 18.

As mentioned above, sleeve 32*a* forms a cylinder in which piston 44, 46 of the seal actuator assembly can reciprocate. Because the seal assembly 18 is disposed within, rather than wholly above, this cylinder, the overall length of the packer may be relatively small without any substantial sacrifice of seal length and effectiveness. Accordingly, the packer of the invention provides the advantages of a longer conventional hydraulic set packer but is short enough to be easily manipulated in tortuous wells having "dog legs" and like deviations from a straight path.

Figure 2:
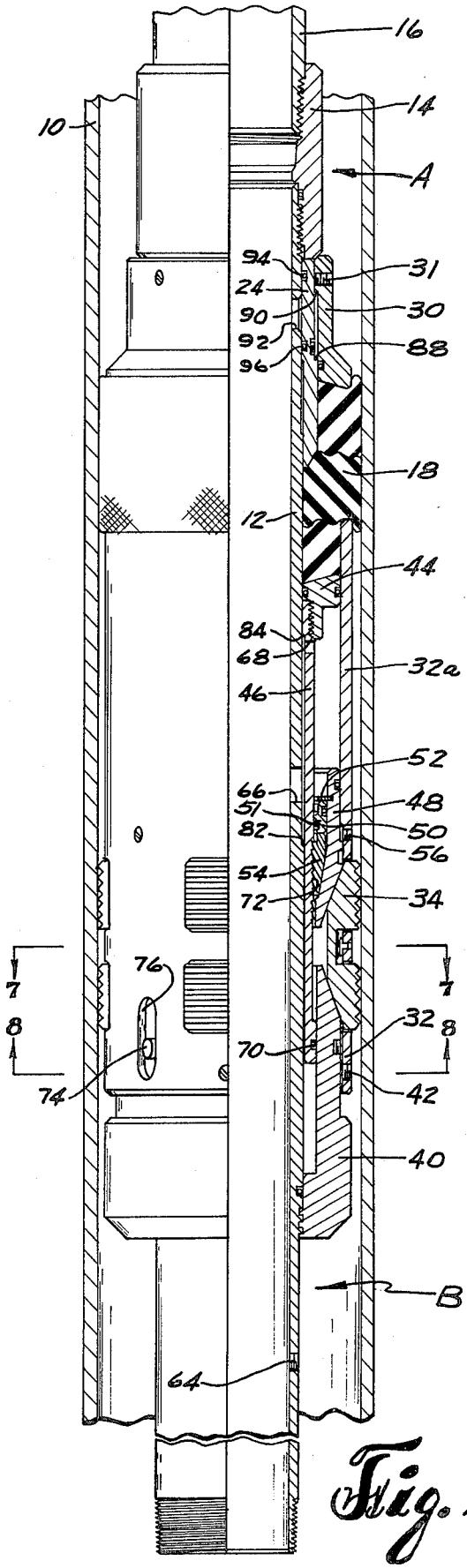
FIG. 2 is a view similar to that of FIG. 1 showing the packer in set condition.
Figure 8:
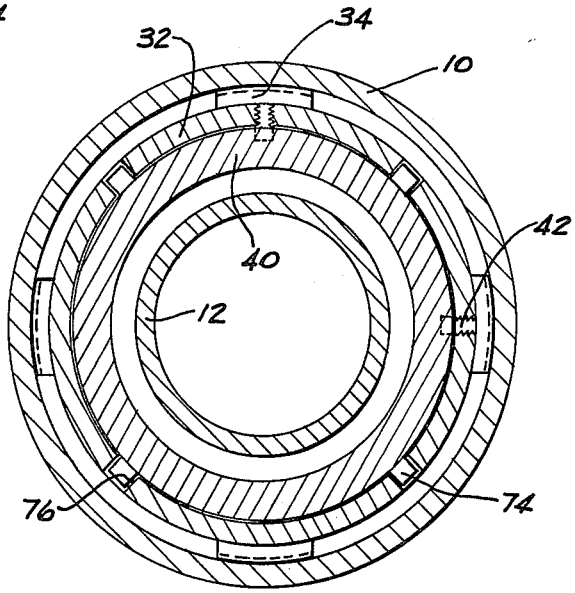
FIG. 8 is a transverse cross-sectional view taken along line 8—8 of FIG. 2.
Figure 7:
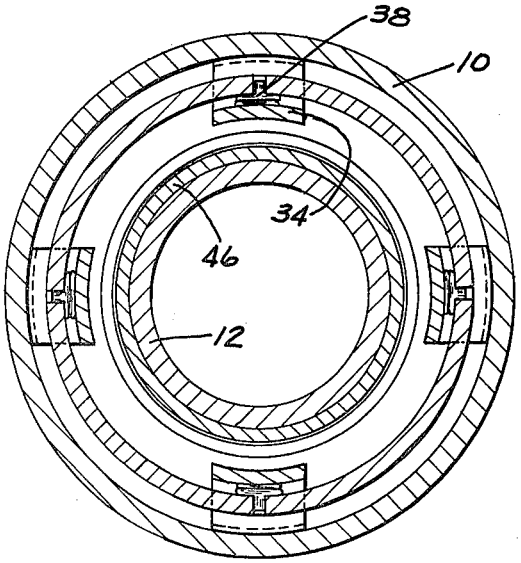
FIG. 7 is a transverse cross-sectional view taken along line 7—7 of FIG. 2.

When the desired depth has been reached, the packer is hydraulically set by pumping a ball plug 60 downwardly through the string 16 and mandrel assembly 12, 14 until it lands on a seat sleeve 62 secured within body 12 by shear pin 64. The application of fluid pressure to the body 12 via the string 16 causes the packer to set. FIGS. 2, 7 and 8 show the packer in set condition, and an understanding of the setting process may best be had by a comparison of those figures with FIGS. 1 and 4–6 in conjunction with the following discussion. A plurality of ports 66 extend radially through the body 12. Similar ports 68 extend through the lock sleeve 46. The portion of sleeve 32*a* disposed generally between the anchor slips 34 and the seal assembly 18 serves as a common cylinder surrounding both the piston 44, 46 of the seal actuator assembly and the piston 48, 50 of the anchor actuator assembly. Fluid supplied through the body 12 enters this cylinder through the ports 66 and 68 and urges piston 44, 46 upwardly and piston 48, 50 downwardly with respect to the body 12 and well casing 10.

As best shown in FIG. 1, the transverse cross-sectional primary piston area defined by the O-rings of member 44 available for reaction to the fluid pressure is substantially equal to the transverse cross-sectional area of the seal assembly 18 in its unextended position. Fluid pressure from ports 66 not only flows into the cylinder formed by sleeve 32*a*, but also flows downwardly along the sleeve 46 to the lower end thereof. The lower end of sleeve 46 is upset on its exterior surface and is sealed against the interior of expander 40 by an O-ring 70. The transverse cross-sectional area defined within the outer diameter of O-ring 70 is slightly greater than the transverse cross-sectional area defined within the inner diameter of the O-ring 51 which seals the sleeve 46 against the holder ring 50. Thus the portion of the lower end of sleeve 46 between these two O-rings defines an auxiliary piston area to increase the total piston area of the piston 44, 46 with respect to the transverse cross-sectional area of the seal assembly 18 in its unset position. This provides a starting boost to the upward force on the actuator assembly to initially overcome the resistive force of the resilient seal assembly 18 constrained between mandrel 12, sleeve 32*a*, piston 44 and members 24 and 30.

Even more importantly, the relationship between the transverse cross-sectional areas of the unset seal and the seal actuator piston permits operation of the tool by an actual setting pressure less than the effective setting pressure. For example, let us assume that, with only the piston area defined by the O-rings of member 44 available for setting, a pressure of 3000 p.s.i. would be required to set the seal 18. Assume also that, once set, the seal 18 would prevent leakage upon the presence of well pressures up to 3000 p.s.i. (ignoring for the time being the seal tightening effect to be described below). With the addition of the piston area defined by the lower end of sleeve 46, the seal 18 may be set by application of an actual setting pressure less than 3000 p.s.i. However, (again ignoring the seal tightening effect) the seal will still hold in the presence of well pressures up to 3000 p.s.i. Thus the latter will be termed the effective setting pressure of the tool.

When sufficient upward force is exerted on the seal 18 via the piston 44, 46, the pins 31 will shear. The lower end 22 of seal assembly 18 will then begin to move upwardly. With the restraining collar 30 thus released, the outer portion of the upper end 20 of the seal assembly will also be permitted to move upwardly until the collar 30 strikes the lower end of collar 14. The initial upward movement of the seal assembly 18 causes the upper end of the seal assembly to move out from under sleeve 32*a*, the elastomer being extruded radially outwardly and upwardly over the retainer sleeve 24. Continued upward movement of the piston 44, 46 urges the seal assembly against the end of the collar 30 thereby compressing the elastomer radially outwardly into sealing engagement with the interior of casing 10. As will be described below, the setting action of the tool also moves the sleeve 32*a* downwardly relative to the body 12 thereby further exposing the seal 18 for engagement with the casing 10. Setting of the seal assembly 18 isolates the areas above and below the packer so that all fluid flow is forced through the body 12.

Several advantages are afforded by the provision of the retainer sleeve 24. Since the sleeve 24 extends radially outwardly from the mandrel body 12, and the upper end of the seal assembly is forced not only upwardly but also radially outwardly over the sleeve 24, less volume of elastomeric material is required to fill and seal off the annular space between the body 12 and the casing 10 than would be necessary if the seal were simply axially compressed. Furthermore, the stretching of the inner extremity of the seal material over sleeve 24 prevents buckling of the seal along its inner diameter and the leakage which could result therefrom.

The fluid pressure introduced into the cylinder formed by sleeve 32*a* to set the seal also urges the piston 48, 50 of the anchor actuator assembly in a downward direction with respect to the casing 10 to set the slips 34. When the downward force becomes great enough, the pins 42 and 56 will shear. The upper expander 48 may then move downwardly with respect to the slips 34. The upper and radially inner surface of each slip 34 is upwardly and radially outwardly inclined. The expander 48 has a correpondingly inclined conical surface engageable with the upper inclined surfaces of the slips 34. Thus the downward movement of the expander 48 with respect to the slips 34 urges the upper halves of the slips radially outwardly by a wedging action. The force on the piston 48, 50 will also cause the piston 48, 50 to move further downwardly toward the lower expander 40 carrying the slip cage 32 and slips 34 with it. The lower inner surfaces of the slips 34 are inclined downwardly and radially outwardly, and the lower expander 40 has a correspondingly inclined conical surface whereby the lower halves of the slips are urged radially outwardly as they move down over the expander 40.

In actual practice, the two sets of shear pins 42 and 56 shear virtually simultaneously and the various movements described above in connection with setting of the anchor assembly occur almost in unison. However, it should be noted that if either set of pins shears before the other, the anchor will still be properly set. Thus, if pins 56 shear first, the upper expander 48 with the ring 50 will move downwardly with respect to the slips 34 until stopped by being wedged between the slips and the sleeve 46. Meanwhile, the upward force exerted on mandrel body 12 via piston 44, 46, seal assembly 18, sleeve 24 and collar 14 will cause the connected lower expander 40 to shear pins 42 and move upwardly behind slips 34 completing the setting thereof. If, on the other hand, pins 42 shear first, members 48, 50, 32 and 34 can move downwardly until the slips 34 are wedged between the expander 40 and the casing 10. Then further exertion of fluid pressure will cause pins 56 to shear so that expander 48 can move further downwardly to set the upper halves of the slips 34. The downward movement of the slip cage 32 during setting of the anchor assembly moves the integral sleeve 32*a* away from the upper end of the seal assembly 18 to expose additional seal area for contact with the casing 10.

It can be seen that, since the pistons 44, 46 and 48, 50 move independently of each other with respect to the casing 10 and in opposite directions, setting of the seal assembly 18 by its actuator will not impede the setting movement of the other actuator or interfere with the setting of the anchor assembly. Likewise, setting of the anchor assembly will not interfere with the proper setting function of the seal assembly or its actuator. Thus there is no need for the pins 31 to shear in any particular sequential order with respect to the aforementioned pins 42 or 56. The various sets of shear pins which must be secured to set the tool may be permitted to shear at random, or more practically, simultaneously. Shear pin 64 holding seat 62 in place is designed to remain intact until pins 31, 42 and 56 have sheared. After the packer is set, the continued application of increased fluid pressure through the string 16 and mandrel assembly 12, 14 will cause the pin 64 to shear permitting the seat 62 and ball 60 to be pumped out of the bottom of string 16 leaving a free passage therethrough.

Figure 4:
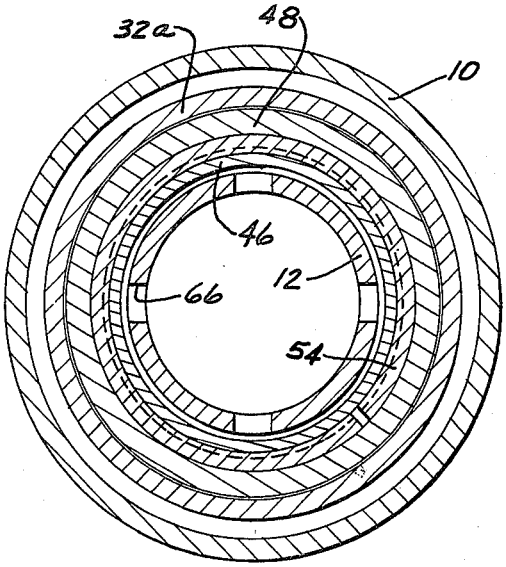
FIG. 4 is a transverse cross-sectional view taken along line 4—4 of FIG. 1.
Figure 5:
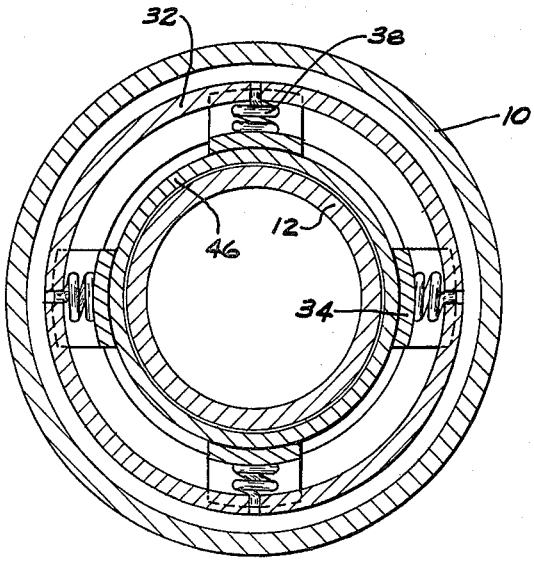
FIG. 5 is a transverse cross-sectional view taken along line 5—5 of FIG. 1.
Figure 6:
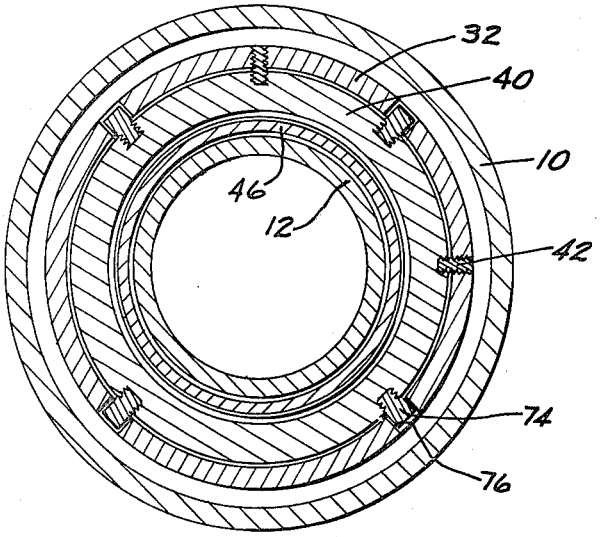
FIG. 6 is a transverse cross-sectional view taken along line 6—6 of FIG. 1.

The packer is held in set condition after release of the fluid setting pressure by a locking mechanism including the lower end of lock sleeve 46, lock ring 54, and anchor actuator piston 48, 50. The radially outer surface of lock ring 54 is inclined upwardly and radially outwardly. The abutting portion of the inner surface of expander 48 is correspondingly inclined. Thus lock ring 54 is trapped between this inclined surface on the expander 48 and the lower end of holder ring 50 and constrained to move generally with the actuator assembly 48, 50. Nevertheless, some longitudinal play between ring 54 and expander 48 is permitted by virtue of the spacing between the inclined interior surface of the expander and the snap ring 52. Radial play is provided for by the fact that the ring 54 is a split ring as shown in FIG. 4.

The inner surface of lock ring 54 is equipped with ratchet teeth. Opposable mating teeth are formed in the exterior of lock sleeve 46 at 72. As the packer is set, the teeth 72 are brought into alignment with the mating teeth on the lock ring 54. The inclination of the teeth is such as to allow upward movement of the seal actuator piston 44, 46 with respect to the anchor actuator piston 48, 50 and entrapped ring 54 and/or downward movement of piston 48, 50 and ring 54 with respect to piston 44, 46. During such movements the ring 54 and sleeve 46 can ratchet past each other by virtue of the play permitted in ring 54. However, if the piston 44, 46 begins to move downwardly, or if the piston 48, 50 begins to move upwardly, the teeth 72 will catch the mating teeth of the ring 54 wedging the latter against the interior inclined surface of the expander 48 whereby such relative movements of the two actuators will be prevented.

With the packer in the set position of FIG. 2, the seal assembly 18 will be tightened in response to a well pressure differential across the seal in either direction. It is of particular significance that the seal will be tightened where the well pressure on the high pressure side of the seal exceeds the effective setting pressure, since many conventional packers will leak under such circumstances.

Recalling the above example, assume that the packer has an effective setting pressure of 3000 p.s.i., although the actual pressure which has been applied to set the packer for this value is less than 3000 p.s.i. due to the auxiliary piston area defined between O-rings 51 and 70. If a pressure in excess of 3000 p.s.i. exists in the annular space A above seal 18 and between the mandrel 12, 14 and the casing 10, and if this pressure is greater than the pressure in annulus B between the mandrel and casing below seal 18, there is a pressure differential across the seal in the downward direction. The fluid pressure in annulus A will act on a reaction area defined by the radially inner and outer extremities of the seal 18, i.e. on an area extending from mandrel body 12 to casing 10. The anchor assembly 32, 34 resists downward movement of the lower end of the seal 18, the force being transmitted to the anchor assembly via sleeve 32*a* and also by sleeve 46 and ring 54. Thus the lower end of seal assembly 18 is prevented from moving downwardly, and the effect of the pressure differential is to move the upper end of seal assembly 18 downwardly toward the lower end thereof. Accordingly, seal assembly 18 is further axially compressed and thereby radially tightened in its set position. In this connection, it is noted that some downward movement of the mandrel body 12 may also take place. This will effect a wedging action on the seal 18 via the retainer sleeve 24 which enhances the seal tightening effect. If such downward movement of the mandrel body 12 should displace the lower expander 40 from tight engagement with slips 34, the packer will still remain anchored since only the upper halves of the slips 34 need be firmly engaged to anchor the packer in the presence of a downward pressure differential as described.

Let us now assume that the fluid pressure in annulus B exceeds that in annulus A so that there is a pressure differential acting upwardly across the seal 18, and further that the pressure in annulus B exceeds 3000 p.s.i., the effective setting pressure. The fluid in annulus B can flow into mandrel body 12 through the open lower end thereof (or the lower end of the attached tubing) and thence through ports 66 and 68. This fluid can act in the upward direction on the piston 44, 46 over the primary piston area defined between the O-rings of abutment member 44, i.e. between the outer diameter of mandrel 12 and the inner diameter of sleeve 32*a*. Fluid pressure in annulus B also acts upwardly on sleeve 32*a* and directly on the portion of seal 18 disposed radially outwardly thereof. The effect of the auxiliary piston area defined between O-rings 51 and 70 is offset by the fact that fluid flowing upwardly over the outer diameter of the expander 40 and then downwardly therein exerts a downward force on an equal but opposite area defined by the upset at the lower end of sleeve 46.

There is thus a pressure reaction area adjacent the lower end of seal 18 equal to the full transverse cross-sectional area between body 12 and casing 10 available for reaction to fluid pressure acting upwardly. However, the upper end of seal 18, which is restrained against upward movement by sleeve 24 and collar 30, has a lesser transverse cross-sectional area, namely the annular area defined between sleeve 24 and casing 10. If the pressure reaction area adjacent the lower end of seal 18 were equal to the transverse cross-sectional area of the upper end of seal 18, the seal would hold at pressures up to the effective setting pressure, e.g. 3000 p.s.i. Since the pressure reaction area exceeds the area of the upper end of the seal, however, a downhole pressure in excess of the effective setting pressure will act on said pressure reaction area to further compress and tighten the seal 18 and leakage will not occur.

Figure 3:
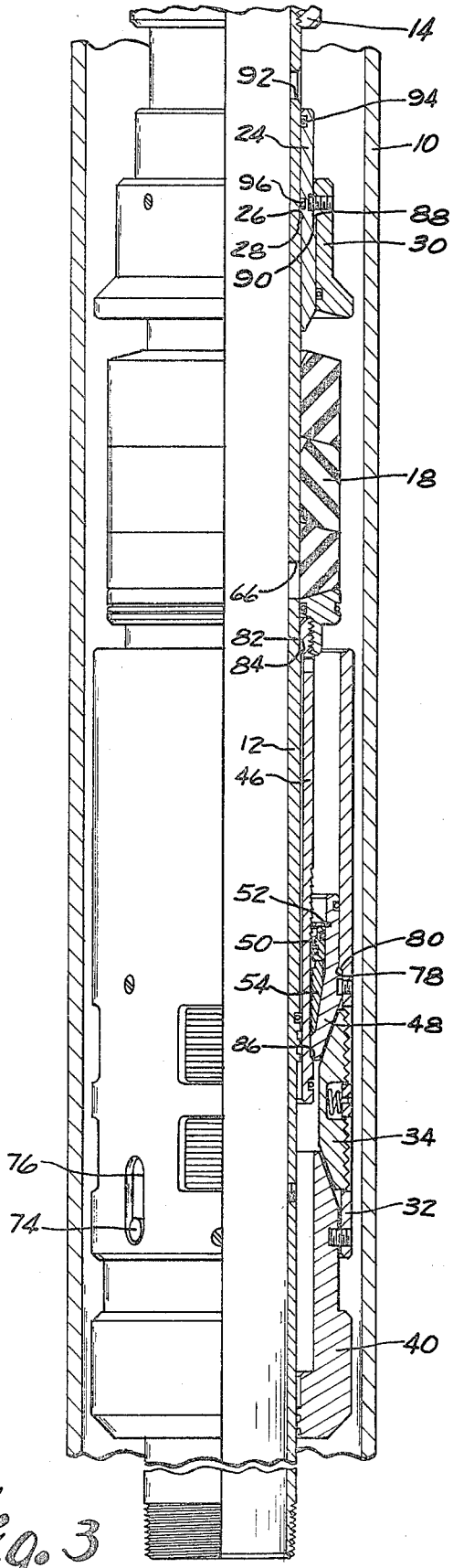
FIG. 3 is a view similar to those of FIGS. 1 and 2 showing the packer released for removal from the well conduit.

To release the packer, the mandrel 12, 14 is rotated via the operating string 16 to release the threaded connection between the body 12 and the lower expander 40. The connection between the expander 40 and the body 12 is threaded oppositely to the connections between the various parts of the drill string so that the expander can be released without disconnecting any of the parts of the operating string. FIG. 3 shows the packer in released condition. After the aforementioned threaded connection is released, the expander 40 and those parts supported thereby will tend to drop downwardly with respect to the mandrel. However, it is preferable, and in many cases necessary, to exert an upward pull on the mandrel via the operating string to force this relative movement.

The expander 40 has a number of support pins 74 extending radially outwardly therefrom into axially elongated slots 76 formed in the slip cage 32. These slots permit the necessary relative movements of the expander 40 and slip cage 32 to effect setting and release of the packer but limit such movement so that the expander 40 may be supported by the slip cage 32 after the expander is released as shown in FIG. 3.

As the body 12 moves upwardly, an external upwardly facing shoulder 82 thereon is brought into engagement with an internal downwardly facing shoulder 84 on the lock sleeve 46 so that the lock sleeve may continue to move upwardly with the body 12. This brings an external upwardly facing shoulder 86 into engagement with the lower end of the upper expander 48. Thus the expander 48 may be moved upwardly with respect to slips 34. During such movement an external upwardly facing shoulder 80 on expander 48 engages an internal downwardly facing shoulder 78 on the slip cage 32. With both expanders 48 and 40 thus removed from setting relation to the slips 34, the latter are returned to their radially inner positions by the springs 38. The various parts of the anchor assembly and actuator assemblies are suspended from the body 12 for removal from the casing 10. In particular, lock sleeve 46 is supported on shoulder 82 of body 12. Upper expander 48 and the rings 50, 52, and 54 carried thereby are supported on shoulder 86 of lock sleeve 46. Slip cage 32, including the integral sleeve 32*a*, is supported on shoulder 80 of the upper expander 48 and in turn supports the slips 34 and the lower expander 40 via pins 74.

The relative upward movement of the mandrel 12, 14 also releases the seal assembly 18. In particular, during such upward movement, the upwardly facing external shoulder 26 on body 12 is brought into engagement with the internal downwardly facing shoulder 28 on the retainer sleeve 28 whereby the latter will begin to move upwardly with the body 12. This in turn brings an external upwardly facing shoulder 88 on sleeve 24 into engagement with an opposed internal shoulder 90 on the collar 30.As sleeve 24 and collar 30 are thus moved upwardly with the body 12, the seal assembly 18 is permitted to retract radially by virtue of its own resiliency.

It can be seen that when the packer is in released condition, the ports 66 are covered by the seal assembly 18. Therefore, in order to provide for pressure equalization across the packer during retrieval, another set of radial ports 92 is provided in the body 12. As seen by comparison with FIGS. 1 and 2, ports 92 are covered by the retainer sleeve 24 in the running-in and set conditions of the packer and are sealed off by O-rings 94 and 96 carried by the sleeve 24 to seal against the body 12 above and below the ports 92. When the packer is released, ports 92 are exposed by the longitudinal movement of the body 12 with respect to sleeve 24.

Figure 9:
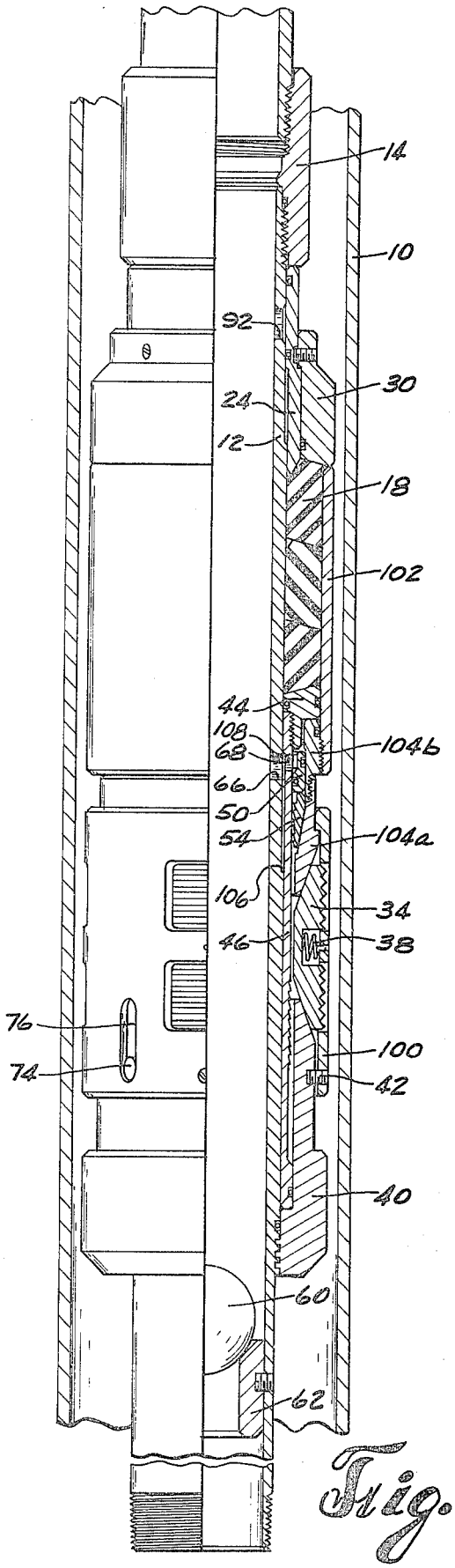
FIG. 9 is a longitudinal quarter-sectional view of a second embodiment of a packer in accord with the present invention just prior to setting.
Figure 10:
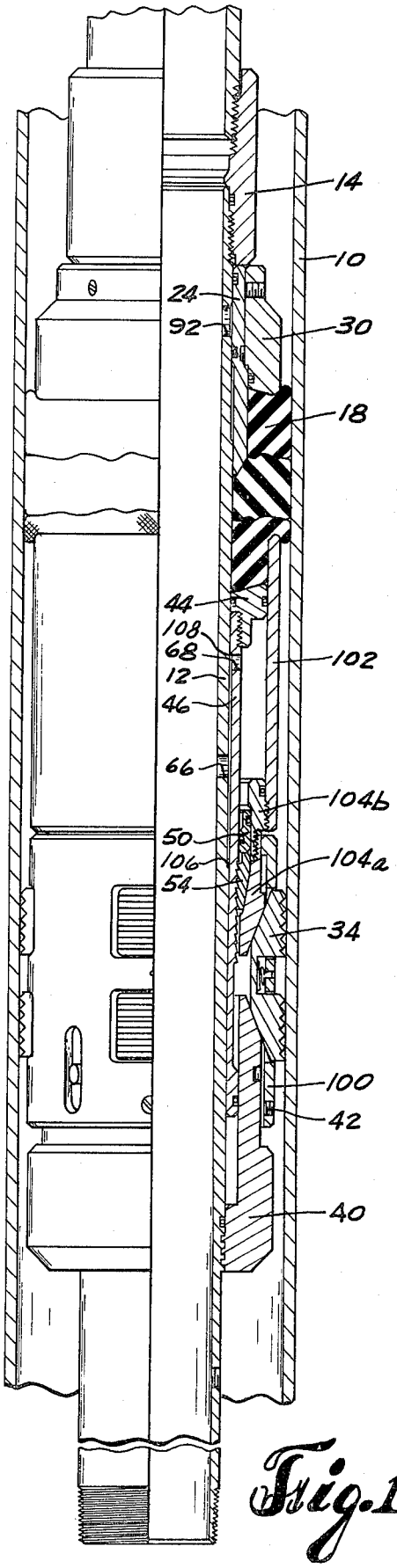
FIG. 10 is a view similar to that of FIG. 9 showing the packer in set condition.
Figure 11:
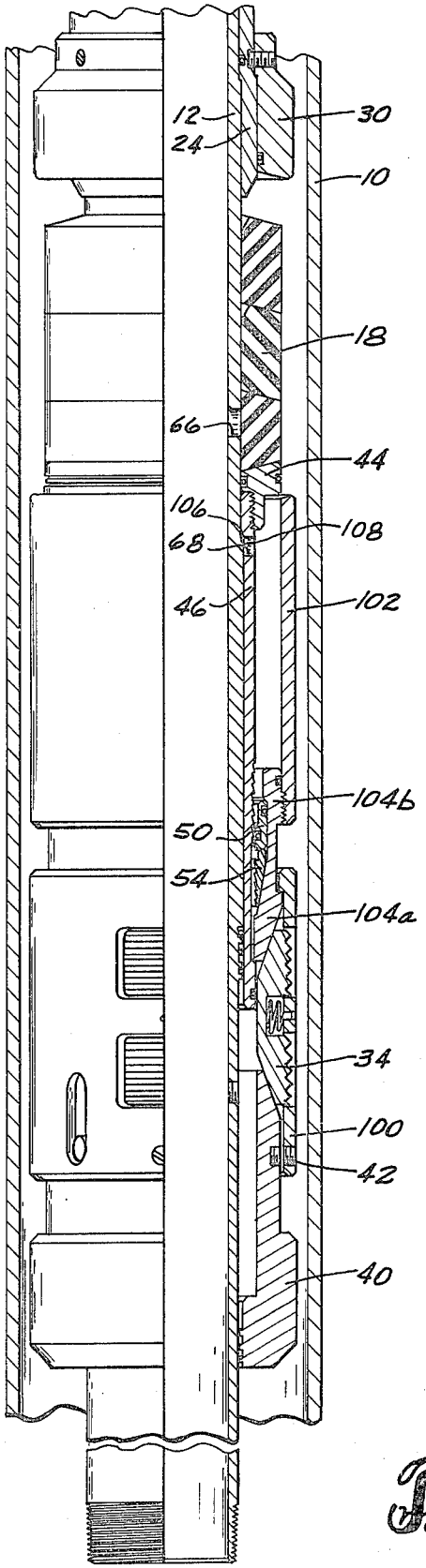
FIG. 11 is a view similar to those of FIGS. 9 and 10 showing the packer in released condition.

Referring now to FIGS. 9–11, there is shown a second embodiment of the packer according to the invention. With the exception of the anchor assembly, upper expander, and seal guard sleeve, the packer of FIGS. 9–11 is substantially identical to that of FIGS. 1–8, and accordingly like parts have been given like reference characters. The primary difference between the two tools is that in the tool illustrated in FIGS. 9–11, the slip cage 100 and seal guard sleeve 102 are not integral but are formed as two separate members which, in the running-in condition of the tool, are longitudinally spaced apart as shown in FIG. 9. The upper expander for the anchor assembly is formed in two parts 104*a* and 104*b* threadedly connected together. The upper part 104*b* of the upper expander is connected to the guard sleeve 102 by a threaded joint rather than by releasable shear pins as in the other embodiment.

When the tool is being run into the well, the expander 104*a*, 104*b* and attached guard sleeve 102 are supported by the slips 34 which in turn are held in their radially inner positions by springs 38. As in the first embodiment, the packer is set by pumping a ball 60 through the operating string to land on the seat 62 and applying the resulting fluid pressure to the cylinder formed by sleeve 102 via ports 66 in body 12 and ports 68 in lock sleeve 46. Piston 44, 46 is thus driven upwardly to release the restraining collar 30 and set the seal assembly 18. Likewise a downward force is exerted on the piston formed by expander 104*a*, 104*b* and ring 50. Expander 104*a*, 104*b* thus urges the slips 34 radially outwardly, and they and the slip cage 100 will begin to move downwardly with the upper expander shearing pins 32 and permitting the lower portions of the slips 34 to be extended by the expander 40.

It can thus be seen that the sleeve 102 will move downwardly a distance equal to the full amount of travel of expander 104*a*, 104*b* relative to body 12 rather than just the amount of like relative travel of the slip cage 100. The required travel is permitted by the initial spacing between the sleeve 102 and slip cage 100. This allows a greater portion of the seal assembly 18 to be exposed during setting whereby a more effective seal is achieved without an increase in the length of the packer or the size of the seal assembly 18.

FIG. 11 shows the packer after it has been released by rotating the body 12 to disconnect the expander 40 therefrom and then raising the mandrel. As in the first embodiment, the lock sleeve 46 is supported on a shoulder 106 on the body 12 via its own mating internal shoulder 108 (see FIG. 10) and in turn supports the expander 104*a*, 104*b*. Sleeve 102 remains threaded to expander part 104*b* while slip cage 100 is suspended from an external shoulder on expander part 104*a*. Expander 40 is in turn suspended from slip cage 100 by pins 74.

It can be seen that, aside from the modifications mentioned above, the embodiment of FIGS. 9–11 also includes all the structural features of the embodiment of FIGS. 1–8, and in particular, that it is adapted to provide the various salient functional advantages of the preceding embodiment including the seal tightening effect, the reduction in actual setting pressure required to set the tool for a given effective pressure, the seal guard, and the retainer sleeve 24 and related longitudinally and radially extrudable seal.

It will also be apparent that numerous modifications of the preferred embodiments may be made without departing from the spirit of the invention. For example, the invention may be applied to packers for sealing against a bare well bore as well as against numerous other types of conduits. The means of releasing the packer may be modified in various ways and, in particular, need not be operated by rotation of the mandrel. The invention may also be applied to other types of packers in which the setting is not achieved solely through the application of fluid pressure.

It is thus intended that the scope of the invention be limited only to the claims which follow.

I claim:

1. A well tool for sealing against a surrounding tubular conduit comprising:

a mandrel;

elastomeric seal means carried externally of said mandrel, said seal means having opposite axial ends and being radially extendable with respect to said mandrel from an unset position to a set position for sealingly engaging said tubular conduit;

first actuator means operatively associated with one end of said seal means to selectively urge said one end in a first longitudinal direction toward the other end of said seal means to set said seal means;

retainer means associated with said other end of said seal means and extending radially outwardly from said mandrel and engageable with only a radially inner portion of said other end of said seal means when in said unset position for restricting movement of said radially inner portion in said first direction;

the radially outer portion of said other end of said seal means being movable relative to said inner portion of said first longitudinal direction whereby said seal means may be extruded in said first longitudinal direction and radially outwardly over said retainer means by said first actuator means;

and tightening means associated with said seal means and responsive to a fluid pressure differential within said tubular conduit across said seal means in either longitudinal direction for tightening said seal means in said set position.

2. The well tool of claim 1 wherein said first actuator means comprises first piston means movable in said first longitudinal direction.

3. The well tool of claim 2 wherein said tightening means comprises means defining a transverse fluid pressure reaction area adjacent said one end of said seal means greater than the transverse cross-sectional area of said other end of said seal means when said seal means is in said set position and adapted to urge said one end of said seal means in said first direction when in said set position.

4. The well tool of claim 2 further comprising:

an anchor assembly including gripping means carried externally of said mandrel and radially extendable with respect thereto;

second actuator means operatively associated with said anchor assembly and comprising second piston means movable relative to said tubular conduit in a second longitudinal direction opposite said first direction to radially extend said gripping means;

and cylinder means surrounding each of said piston means, said mandrel being tubular and having port means communicating with said cylinder means.

5. The well tool of claim 4 wherein said first and second piston means are annular and surround said mandrel, and wherein one of said actuator means includes an annular sleeve defining the respective one of said first and second piston means, said sleeve having port means therethrough providing communication between the port means of said mandrel and said cylinder means.

6. The well tool of claim 5 wherein said cylinder means comprises a common cylinder surrounding both of said first and second piston means.

7. The well tool of claim 5 further comprising lock means cooperative between said sleeve and the other of said actuator means permitting relative movement of said first and second piston means in said first and second directions respectively, but preventing relative movement between said first and second piston means in said second and first directions respectively.

8. The well tool of claim 4 further comprising a plurality of shear means for retaining said anchor assembly and said seal means independently in respective unextended positions, said shear means being releasable upon the application of fluid pressure to said piston means.

9. The well tool of claim 8 wherein said shear means are designed to shear substantially simultaneously.

10. The well tool of claim 4 further comprising first stop means carried by said mandrel and abutting said seal means to limit longitudinal movement of said seal means in said first direction, and second stop means carried by said mandrel and abutting said anchor assembly to limit longitudinal movement of said anchor assembly in said second direction, one of said stop means being releasably longitudinally fixed to said mandrel.

11. The well tool of claim 10 wherein said one stop means is threadedly secured to said mandrel and is releasable by rotation of said mandrel.

12. The well tool of claim 11 wherein said one stop means comprises an expander for said anchor assembly.

13. The well tool of claim 1 further comprising a restraining collar abutting the radially outer portion of said other end of said seal means in said unset position and releasably secured to said mandrel for limited movement in said first direction relative to said retainer means.

14. The well tool of claim 13 wherein said retainer means includes a wedge surface so engageable with said inner portion of said other end of said seal means, said wedge surface being inclined radially inwardly toward said mandrel.

15. A well tool for sealing against a surrounding tubular conduit comprising:

a mandrel;

seal means carried externally of said mandrel and radially extendable with respect thereto from an unset position to a set position for sealingly engaging said tubular conduit;

an anchor assembly including gripping means carried externally of said mandrel and radially extendable with respect thereto;

first actuator means operatively associated with said seal means to urge said seal means to said set position and including first piston means comprising a sleeve surrounding said mandrel and having means defining a primary piston area and means longitudinally spaced therefrom along said sleeve defining an auxilliary piston area, said sleeve being movable in a first longitudinal direction to radially extend said seal means;

second actuator means operatively associated with said anchor assembly and comprising second piston means movable relative to said tubular conduit in a second longitudinal direction opposite said first direction to radially extend said gripping means;

and cylinder means surronding each of said piston means, said mandrel being tubular and having port means therethrough, and said sleeve having port means therethrough providing communication between the port means of said mandrel and said cylinder means.

16. The well tool of claim 15 wherein said primary piston area and said auxiliary piston area of said first actuator means comprise a total transverse cross-sectional piston area greater than the transverse cross-sectional area of said seal means in said unset position.

17. A well tool for sealing against a surrounding tubular conduit comprising:

a mandrel;

seal means carried externally of said mandrel and radially extendable with respect thereto from an unset position to a set position for sealingly engaging said tubular conduit;

an anchor assembly including gripping means carried externally of said mandrel and radially extendable with respect thereto;

first actuator means operatively associated with said seal means to urge said seal means to said set position and comprising first piston means movable in a first longitudinal direction to radially extend said seal means;

second actuator means operatively associated with said anchor assembly and comprising second piston means movable relative to said tubular conduit in a second longitudinal direction opposite said first direction to radially extend said gripping means;

cylinder means surrounding each of said piston means, said mandrel being tubular and having port means communicating with said cylinder means;

and guard means externally overlying said seal means in said unset position and movable relative to said seal means to at least partially expose said seal means.

18. The well tool of claim 17 further comprising control means interconnecting said mandrel and said guard means for maintaining said guard means in overlying relation to said seal means and releasable to permit relative movement between said guard means and said seal means.

19. The well tool of claim 17 wherein said guard means comprises at least a portion of said cylinder means.

20. The well tool of claim 17 wherein said guard means is connected to said second actuator means and movable therewith in said second direction.

21. A well tool for sealing against a surrounding tubular conduit comprising;

a mandrel;

seal means carried externally of said mandrel and radially extendable with respect thereto from an unset position to a set position for sealingly engaging said tubular conduit;

first actuator means operatively associated with said seal means and comprising an annular sleeve defining first piston means movable in a first longitudinal direction to urge said seal means to said set position, said first piston means including a primary piston area on said sleeve and an auxiliary piston area on said sleeve and spaced longitudinally along said sleeve from said primary piston area, said sleeve having a maximum transverse cross-sectional area less than or equal to the transverse cross-sectional area of said seal means in said unset position yet providing an effective total transverse cross-sectional piston area greater than the transverse cross-sectional area of said seal means in said unset position;

an anchor assembly including gripping means carried externally of said mandrel and radially extendable with respect thereto;

second actuator means operatively associated with said anchor assembly and comprising second piston means movable relative to said tubular conduit in a second longitudinal direction opposite said first direction to radially extend said gripping means;

cylinder means surrounding each of said piston means;

and means providing fluid communication between said piston means and the interior of said mandrel, including a port through said mandrel communicating with said cylinder means.

22. The well tool of claim 21 wherein said sleeve has port means therethrough providing communication between the port means of said mandrel and said cylinder means.

23. The well tool of claim 21 further comprising lock means cooperative between said sleeve and the other of said actuator means permitting relative movement of said first and second piston means in said first and second directions respectively, but preventing relative movement between said first and second piston means in said second and first directions respectively.

24. A well tool for sealing against a surrounding tubular conduit comprising:

a mandrel;

elastormeric seal means having opposite axial ends and carried externally of said mandrel and radially extendable with respect thereto from an unset position to a set position for sealingly engaging said tubular conduit;

first fluid pressure operated actuator means operatively associated with one end of said seal means to radially extend said seal means from said unset position to said set position by selectively urging said one end in a longitudinal direction toward the other end of said seal means;

a guard sleeve externally overlying said seal means and having one axial end disposed adjacent said other end of said seal means so that said guard sleeve substantially covers said seal means in said unset position, said guard sleeve being relatively movable with respect to said seal means to at least partially expose said seal means;

and control means including a restraining member axially abuting an outer portion of said other end of said seal means and said one end of said sleeve, and being releasably connected to said mandrel.

25. The well tool of claim 24 further comprising stop means for limiting longitudinal movement of said restraining member with respect to said mandrel in said longitudinal direction.

26. The well tool of claim 24 further comprising retainer means associated with said other end of said seal means and extending radially outwardly from said mandrel for restricting movement of a radially inner portion of said other end in said longitudinal direction, the outer portion of said other end of said seal means being movable relative to said inner portion in said longitudinal direction whereby said seal means may be extruded in said longitudinal direction and radially outwardly over said retainer means by said first actuator means.

27. The well tool of claim 24 wherein said first actuator means comprises cylinder means, said guard sleeve comprising at least a portion of said cylinder means.

28. The well tool of claim 24 further comprising an anchor assembly including gripping means carried externally of said mandrel and radially extendable with respect thereto, and second actuator means operatively associated with said anchor assembly and longitudinally movable relative to said tubular conduit to radially extend said gripping means, and wherein said guard sleeve is connected to said second actuator means and longitudinally movable therewith.

29. The well tool of claim 24 including means associated with said seal means and responsive to fluid pressure within said tubular conduit acting in either longitudinal direction with respect to said tubular conduit for tightening said seal means in said set position.

30. A well tool for sealing against a surrounding tubular conduit comprising:

a mandrel;

seal means carried externally of said mandrel and radially extendable with respect thereto by axial compression from an unset position to a set position for sealingly engaging said tubular conduit;

first actuator means comprising first piston means operatively associated with said seal means and movable relative to said mandrel in a first longitudinal direction to axially compress and thereby radially extend said seal means from said unset position to said set position;

and cylinder means for said first actuator means surrounding said first piston means and at least partially externally overlying said seal means in said unset position.

31. The well tool of claim 30 wherein said cylinder means overlies said seal means over substantially the entire axial extent of said seal means in said unset position.

32. The well tool of claim 30 further comprising:

an anchor assembly including gripping means carried externally of said mandrel and radially extendable with respect thereto;

second actuator means operatively associated with said anchor assembly and movable relative to said tubular conduit in a second longitudinal direction opposite said first direction to radially extend said gripping means, said second actuator means comprising second piston means;

and wherein said cylinder means surrounds each of said piston means, said mandrel being tubular and having port means communicating with said cylinder means.

33. The well tool of claim 32 wherein said cylinder means is connected to said second actuator means and movable therewith in said second direction to at least partially expose said seal means.

34. The well tool of claim 33 wherein said first and second piston means are annular and surround said mandrel, and wherein one of said actuator means includes an annular sleeve defining the respective one of said first and second piston means and having port means therethrough providing communication between the port means of said mandrel and said cylinder means.

35. The well tool of claim 34 wherein said cylinder means comprises a common cylinder surrounding both of said first and second piston means.

36. The well tool of claim 34 further comprising lock means cooperative between said sleeve and the other of said actuator means permitting relative movement of said first and second piston means in said first and second directions respectively, but preventing relative movement between said first and second piston means in said second and first directions respectively.

37. The well tool of claim 34 wherein said one actuator means is said first actuator means and said sleeve comprises means defining a primary piston area and means longitudinally spaced therefrom along said sleeve defining an auxiliary piston area.

38. The well tool of claim 37 wherein said primary piston area and said auxiliary piston area of said first actuator means define a total transverse cross-sectional piston area greater than the transverse cross-sectional area of said seal means in said unset position.

39. The well tool of claim 30 further comprising control means interconnecting said mandrel and said cylinder means for maintaining said cylinder means in overlying relation to said seal means in said unset position and releasable to permit relative movement between said cylinder means and said seal means to at least partially expose said seal means.

40. The well tool of claim 30 wherein said seal means is elastomeric and has opposite axial ends; wherein said first actuator means is operatively associated with said one end of said seal means for selectively urging said one end in said first longitudinal direction toward the other end of said seal means; said tool further comprising retainer means associated with the other end of said seal means and extending radially outwardly from said mandrel for restricting movement of a radially inner portion of said other end in said first longitudinal direction; and the outer portion of said other end of said seal means being movable relative to said inner portion in said first longitudinal direction whereby said seal means may be extruded in said first longitudinal direction and radially outwardly over said retainer means by said first actuator means.

41. A well tool comprising:

a mandrel;

elastomeric seal means carried externally of said mandrel and having opposite axial ends;

actuator means operatively associated with one end of said seal means and longitudinally movable with respect to said mandrel for selectively urging said one end in a longitudinal direction toward the other end of said seal means to radially extend said seal means from an unset position to a set position;

retainer means associated with said other end of said seal means and extending radially outwardly from said mandrel and engagable with only a radially inner portion of said other end of said seal means when in said unset position for restricting movement of said radially inner portion in said longitudinal direction;

the outer portion of said other end of said seal means being movable relative to said inner portion in said longitudinal direction whereby said seal means may be extruded in said longitudinal direction and radially outwardly over said retainer means by said actuator means.

42. The well tool of claim 41 further comprising a restraining member abutting the outer portion of said other end of said seal means and releasably connected to said mandrel.

43. The well tool of claim 42 further comprising stop means for limiting movement of said restraining member with respect to said mandrel in said longitudinal direction.

* * * * *